US007475841B2

(12) United States Patent
Fancher

(10) Patent No.: US 7,475,841 B2
(45) Date of Patent: Jan. 13, 2009

(54) SPRING RETRACTABLE REEL HAVING A PNEUMATIC RETRACTION GOVERNOR

(75) Inventor: Dennis Fancher, Westerlo, NY (US)

(73) Assignee: Hannay Reels, Inc., Westerlo, NY (US)

( * ) Notice: Subject to any disclaimer, the term of this patent is extended or adjusted under 35 U.S.C. 154(b) by 101 days.

(21) Appl. No.: 11/621,138

(22) Filed: Jan. 9, 2007

(65) Prior Publication Data

US 2008/0164361 A1 Jul. 10, 2008

(51) Int. Cl.
*B65H 75/30* (2006.01)

(52) U.S. Cl. ..... 242/381; 242/381.5

(58) Field of Classification Search ..... 242/381, 242/381.5, 396

See application file for complete search history.

(56) References Cited

U.S. PATENT DOCUMENTS

| | | | | |
|---|---|---|---|---|
| 2,521,178 | A | 9/1950 | Meletti | 242/107 |
| 2,662,483 | A | 12/1953 | Smith et al. | 103/136 |
| 2,954,190 | A | 9/1960 | Le Clair | 244/135 |
| 3,193,190 | A | 7/1965 | Lindberg | 230/152 |
| 3,211,396 | A | 10/1965 | McQuillen | 242/156.2 |
| 3,282,222 | A | 11/1966 | Raufeisen at al. | 103/118 |
| 4,050,855 | A | 9/1977 | Sakamaki et al. | 418/131 |
| 4,173,332 | A | 11/1979 | DuLondel | 254/160 |
| 4,367,863 | A | 1/1983 | Dulondel et al. | 254/391 |
| 4,422,583 | A | 12/1983 | Maxner et al. | 242/45 |
| 4,434,974 | A | 3/1984 | LaCount | 254/360 |
| 4,446,884 | A | 5/1984 | Rader, Jr. | 137/355.23 |
| 4,452,430 | A | 6/1984 | Kankkunen | 254/391 |
| 5,135,181 | A | 8/1992 | Wesselink | 242/107.3 |
| 5,725,199 | A | 3/1998 | Yamamoto | 254/360 |
| 6,086,007 | A | 7/2000 | Till | 242/381 |
| 6,158,684 | A | 12/2000 | Hedlund | 242/381 |
| 6,234,417 | B1 | 5/2001 | Sauder et al. | 242/381 |
| 6,467,713 | B1 | 10/2002 | Watanabe et al. | 242/375.1 |
| 6,488,224 | B1 | 12/2002 | Hiebenthal | 242/381 |
| 6,619,313 | B2 | 9/2003 | Boughton et al. | 137/355.16 |

*Primary Examiner*—Sang Kim
(74) *Attorney, Agent, or Firm*—Heslin Rothenberg Farley & Mesiti P.C.

(57) ABSTRACT

A spring retractable reel having a pneumatic retraction governor or air motor for regulating the rewind speed of a spool for taking up a line of material. For example, an air motor includes a rotor having vanes, a first port opening onto one side of the rotor, and a second port opening onto a second side of the rotor. A valve adjustably restricts a continuous flow of ambient air through the second port, and the valve defines an opening sized smaller than the first port. The rotation of the spool and the rotor are fixedly coupled together, for example, with a chain. When the spool rewinds the line of material, the rotor rotates, which in turn draws ambient air through the first port, a portion of which ambient air is restricted from exiting the second port due to the valve thereby compressing air within the air motor to regulate or limit the speed at which the spool rewinds the line of material.

17 Claims, 4 Drawing Sheets

SPRING RETRACTABLE REEL HAVING A PNEUMATIC RETRACTION GOVERNOR

FIELD OF THE INVENTION

The invention relates to spring-retractable reels commonly referred to as spring reels, and methods for regulating the rewind speed of the reel.

BACKGROUND OF THE INVENTION

Hoses and electrical cords are frequently wound upon a spring-loaded reel. When it is desired to use the hose or electrical cord, the hose or cord is pulled from the reel against the action of a spring. When the hose or cord has been pulled to its desired extended position, the spring-loaded reel normally employs a latching system to maintain the hose or cord in the extended position. When it is desired to rewind or retract the hose or cord, the hose or cord is pulled outwardly a small amount to disengage the latching system. The spring-loaded reel then rewinds the hose or cord thereon due to the spring causing the retraction rotation of the reel. In the event that the operator should lose his grip on the hose or cord as it is being rewound by the spring associated with the reel, the hose or cord could strike a person or object causing damage to the person or object as well as damage to the equipment associated with the hose or cord. In addition, when the hose or cord is in its extended position, the latching mechanism sometimes becomes disengaged which causes the spring-loaded reel to rapidly rewind the hose or cord upon the reel which may also result in the hose or cord striking a person or object.

One attempt at regulating the speed of the rewinding of a spring-loaded reel is U.S. Pat. No. 6,488,224 issued to Hiebenthal, which discloses a hydraulic braking mechanism or governor mounted on a spring-loaded reel for controlling the rate of rotation of the reel as the elongated member is wound upon the wheel. The governor or braking mechanism comprises a hydraulic gear pump which is mounted on the reel support and which includes an internal hydraulic circuit consisting of a variable metering valve which is used to control the free retraction speed of the spring-powered rewind reel. The restricted flow causes a resistance to rotation of the pump shaft of the hydraulic pump causing a braking force on the spring reel. A clutch bearing is provided to permit the free-wheeling of the reel during the unwinding step.

U.S. Pat. No. 6,234,417 issued to Sauder et al. discloses a hose reel retractor with a unidirectional viscous speed governor comprising multiple disks housed in a chamber filled with a viscous fluid coupled to the reel to provide a retarding force that is proportional to velocity.

U.S. Pat. No. 6,086,007 issued to Till discloses a viscously damped cord retract. The system includes a spool, a spring, an air-damper member, and a housing member. The spool is adapted to receive and store varying lengths of a flexible member. The air-damper member is concentrically disposed in the spool and defines at least two rotatable air filled chambers or channels. The house member secures the spool and the air-damper member in a concentric enclosed airy arrangement. An airy chamber defines an enclosure that is not open to a free circulation of air but is penetrable by a limited volume of air.

U.S. Pat. No. 4,422,583 issued to Maxner et al. discloses a wire feeder having a dampening means to inhibit rotation of a reel of wire. The damping means includes a cylinder having a piston with a piston rod. A plurality of valves regulate the air in and out of the ends of the cylinder to dampen or brake the rotation of the reel shaft, and thus, dampen the inertia of the reel as it rotates.

U.S. Pat. No. 4,173,332 issued to DuLondel discloses a rotary speed limiter device particularly useful as a fire escape device. The device has a rotary speed limiter member mounted on a shaft to slide axially on the shaft and to rotate with it. Means, the speed of which is to be controlled, rotates the shaft. As the shaft is rotated, means applies a braking force on the speed limiter member, causing it to compress air in a surrounding support body and to move axially on the shaft, to limit the speed of the shaft rotating means.

Other non-spring-retractable reels have employed rewind motors, for example, which use compressed air and liquid for aiding the rewinding of the cable or hose.

There is a need for further spring-retractable reels and methods for regulating the rewind speed of the reel.

SUMMARY OF THE INVENTION

The present invention provides, in a first aspect, a spring retractable reel which pneumatically governs the retraction of a line of material. The spring retractable reel includes a frame, a spool rotatably supported on the frame, a spring for biasing the spool to take up the line of material, and an air motor mounted on the frame. The air motor includes a housing having a chamber therein, and a rotor having an axial shaft and a plurality of vanes. The rotor is eccentrically disposed relative to the chamber of the housing. A first port in communication with ambient air opens into the chamber on a first side of the rotor, and a second port in communication with ambient air opens into the chamber on a second side of the rotor. An adjustable valve is provided for adjustably restricting a flow of air through the second port. The valve defines a second sized opening sized smaller than a first sized opening of the first port. A first sprocket is mounted on the spool for rotation therewith, and a second sprocket is mounted on the shaft of the rotor. A chain fixedly couples the rotation of the spool and the first sprocket to the rotation of the second sprocket in both an unwinding direction and a retraction direction. The first sprocket is larger than the second sprocket. When the line of material is pulled off the spool reel, the spring is tensioned and the rotor rotates generally freely as a flow of ambient air is draw through the valve into the chamber and generally unrestricted out the first port into ambient air. When the spool rewinds the line of material under the action of the spring in the retraction direction, the rotor rotates in an opposite direction, which in turn draws a flow of ambient air through the first port, a portion of the flow of the ambient air drawn through the first port being restricted from exiting the second port due to the valve thereby compressing air within the chamber to regulate the speed at which the spool rewinds the line of material.

The present invention provides in a second aspect, a spring retractable reel which pneumatically governs the retraction of a line of material. The spring retractable reel includes a frame, a spool rotatably supported on the frame, a spring for biasing the spool to take up the line of material, and a pneumatic retraction governor mounted on the frame. The pneumatic retraction governor includes a rotor having a plurality of vanes, a first port having a first opening, and a second port. A valve is provided for adjustably restricting a flow of air through the second port. The valve defines a second sized opening sized smaller than a first sized opening of the first port. Means are provided for fixedly coupling a rotation of the spool to a rotation of the rotor of the pneumatic retraction governor in both an unwinding direction and a retraction direction. When the line of material is pulled off the spool, the spring is tensioned and the rotor rotates generally freely as a flow of ambient air is draw through the valve into the chamber and generally unrestricted out the first port into ambient air. When the spool rewinds the line of material under the action of the spring in the retraction direction, the rotor rotates in an opposite direction, which in turn draws ambient air through the first port, a portion of the ambient air drawn through the first port is restricted from exiting the second port due to the valve thereby compressing air within the chamber to regulate the speed at which the spool rewinds the line of material.

The present invention provides, in a third aspect, a method for regulating a speed of retraction of a line of material on a spool. The method includes providing a spring retractable reel as described above, the spring retractable reel having a spring for retracting the spool, and a valve for adjustably restricting a flow of air through an air motor. The line of material from the spring retractable reel is dispensed to tension the spring. The line of material is retracted on spool under the action of the spring, and a flow of air out of the valve is regulated so that air in the air motor is compressed and the speed at which the line of material is retracted is regulated.

The present invention provides, in a fourth aspect, a method for regulating a speed of retraction of a line of material on a spool. The method includes dispensing the line of material from the spool rotating in a first direction to tension a spring, releasing the tension of the spring to rotate the spool in a second opposite direction to rewind the line of material on the spool, and fixedly coupling the rotation of the spool to a compression of a continuous flow of air to regulate the speed of retraction of the line of material on the spool.

BRIEF DESCRIPTION OF THE DRAWINGS

The present matter which is regarded as the invention is particularly pointed out and distinctly claimed in the concluding portion of the specification. The present invention, however, may best be understood by reference to the following detailed description of various embodiments and the accompanying drawings in which:

DETAILED DESCRIPTION OF THE INVENTION

The present invention, in one aspect, is directed to spring retractable reels which pneumatically govern the rewind speed of a line of material such as a cable or a hose on the reel. For example, the present invention controls the free retraction speed of the reel during the rewinding process should an operator lose one's grip on the cable or hose, or should the latching mechanism become inadvertently disengaged which would normally cause the cable or hose to be rewound on the reel at a high rate of speed.

Figure 1:
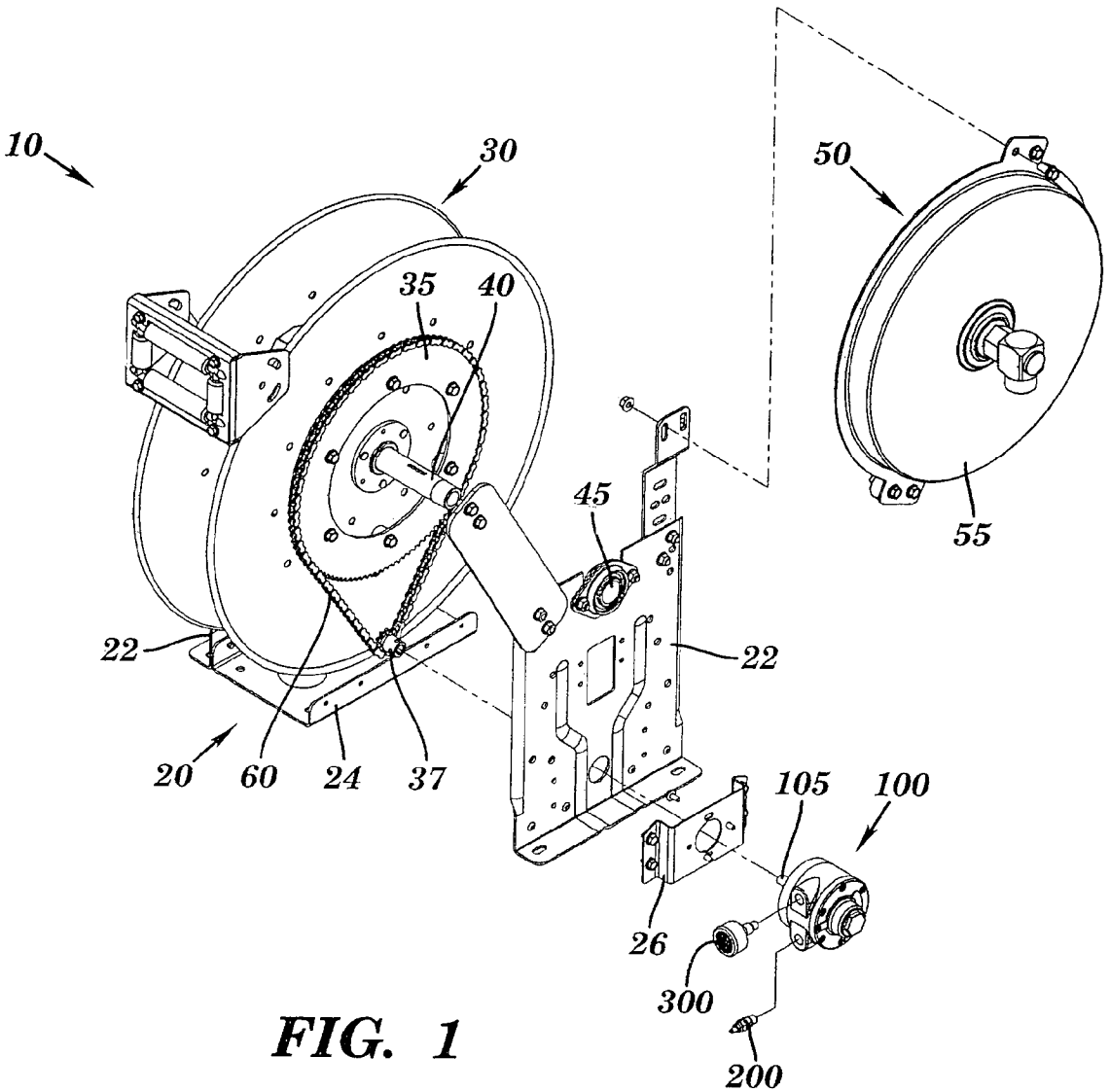
FIG. 1 is an exploded perspective view of one embodiment of a spring retractable reel having an air motor for retracting a line of material in accordance with the present invention.

FIG. 1 illustrates one embodiment of a spring retractable reel 10 in accordance with the present invention for dispensing and retracting a line of material (not shown) such as a hose, a cable, or other type of line of material. The illustrated spring retractable reel generally includes a frame 20, a spool 30 for holding the line of material, and an air motor 100 for regulating the rewind speed of the spring retractable reel.

Frame 20 generally includes a pair of spaced-apart vertically disposed plates 22 and a base 24. Spool 30 is supported on a shaft 40. The ends of shaft 40 are rotatably supported by bearings 45 (only one of which is shown in FIG. 1) attached to plates 22. It will be appreciated that other types and shapes of frames may be employed, e.g., frames or supports formed from round or square tube members. In addition, the frame may include wheels to allow the spring retractable reel to be readily moved from one location to another location.

A spring motor 50 includes a spring (not shown in FIG. 1) disposed in a cover 55. The cover is attached to the frame. One end of the spring is attached to the cover and the other end of the spring is attached to the shaft. The spring operably biases the spool to take up the line of material. The housing protects the spring and reduces the likelihood of risk of injury to an operator from the spring.

A first sprocket 35 such as a disc sprocket is mounted, e.g., using a plurality of bolts and nuts, on spool 30 for rotation therewith. First sprocket 35 is operably fixedly connected via a chain 60 to a second sprocket 37 which is attached to air motor 100. Air motor 100 is mounted on a mounting plate 26 which attaches to frame 20.

Figure 2:
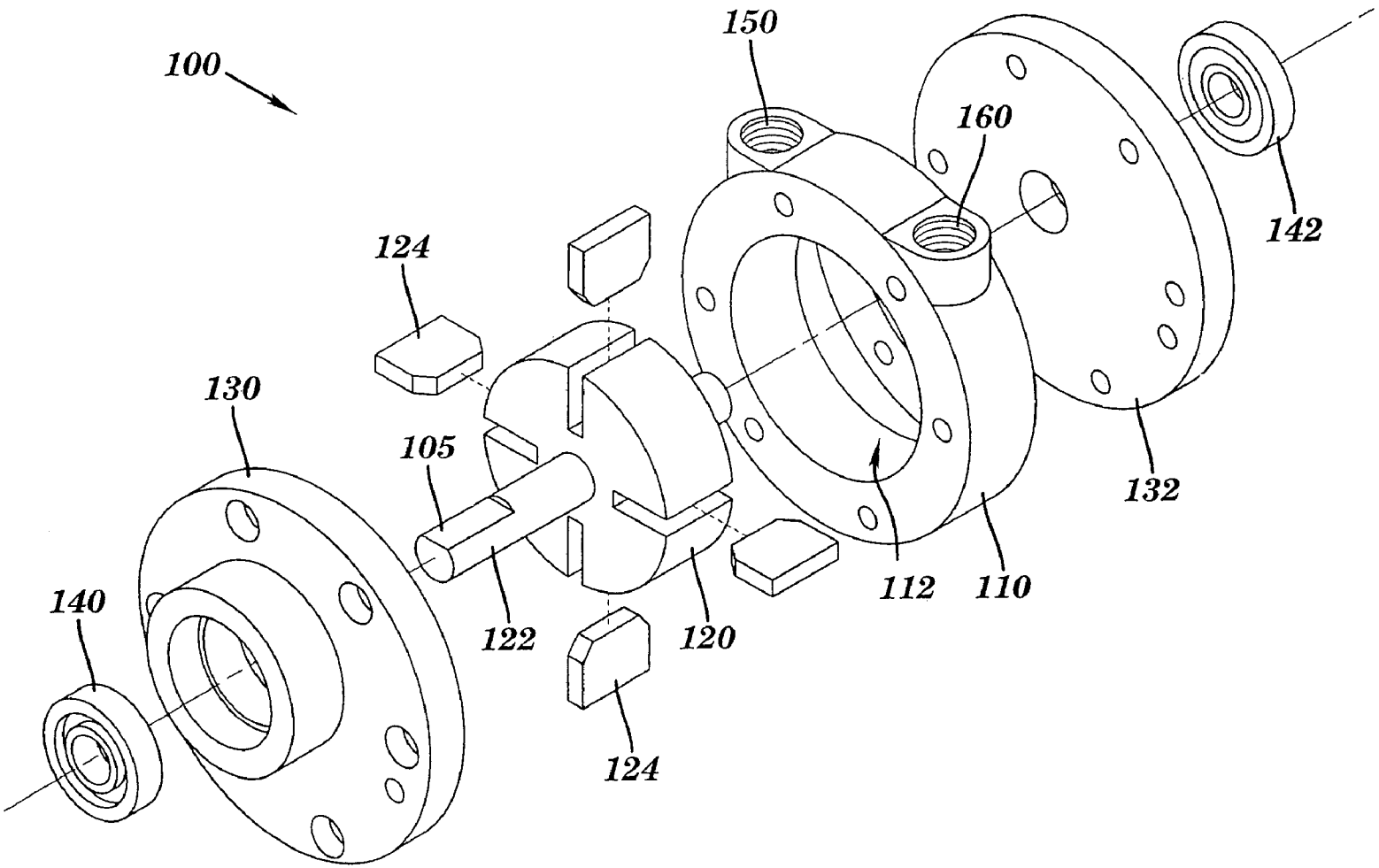
FIG. 2 is an enlarged, exploded perspective view of the air motor of FIG. 1.
Figure 4:
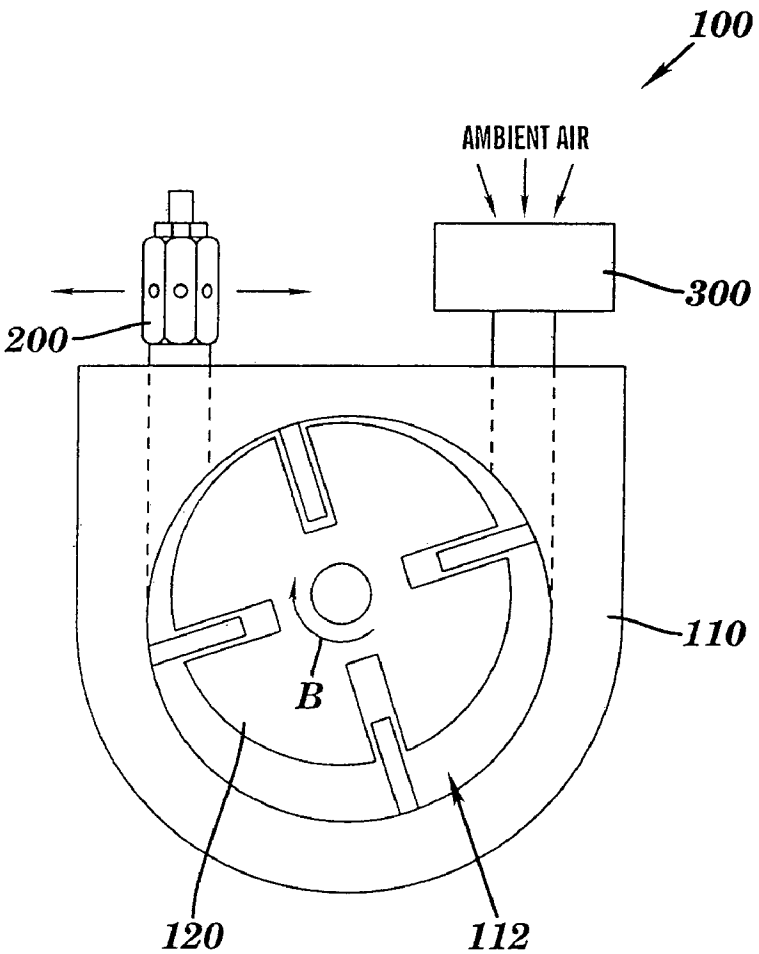
FIG. 4 is an enlarged, cross-sectional view of the air motor of FIG. 1 illustrating the operation during retraction of a line of material on a spool.
Figure 3:
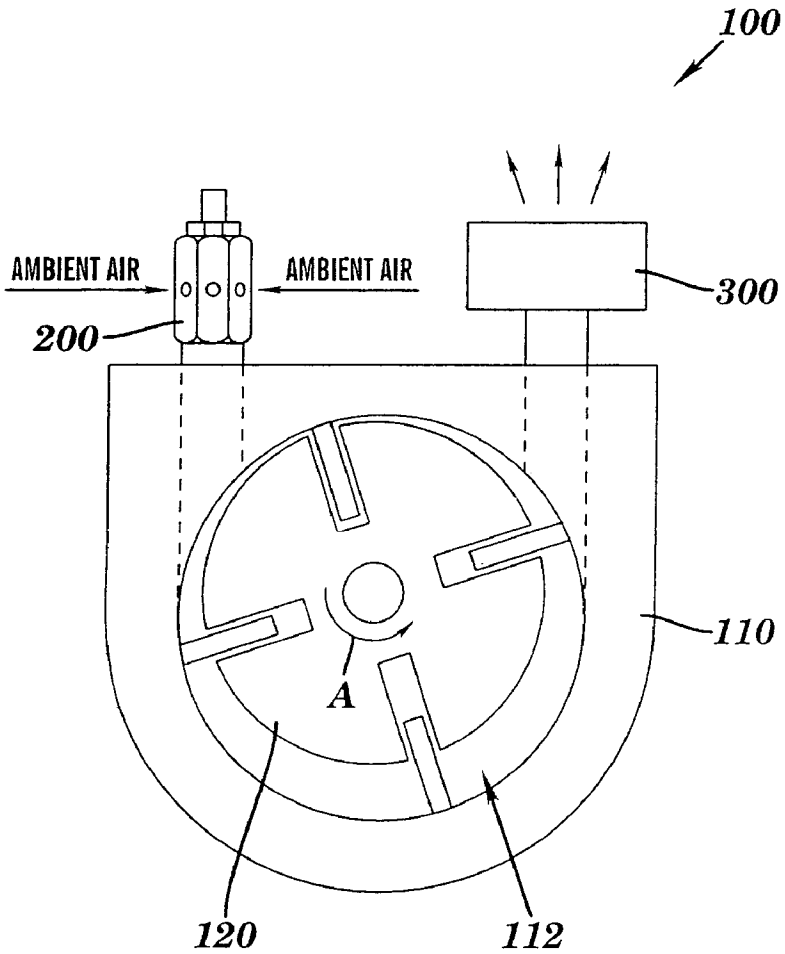
FIG. 3 is an enlarged, cross-sectional view of the air motor of FIG. 1 illustrating the operation during withdrawal of a line of material on a spool.

As shown in FIG. 2, air motor 100 generally includes a housing 110 having a chamber 112 therein, a rotor 120 attached to an axial shaft 122 and a plurality of vanes 124, end plates 130 and 132, and bearings 140 and 142. As best shown in FIGS. 3 and 4, rotor 120 may be eccentrically disposed relative to chamber 112 of housing 110 of air motor 100. With reference again to FIG. 2, a first port 150 opens into chamber 112 on a first side of rotor 120, and second port 160 opens into chamber 112 on a second side of rotor 120. Other components of the air motor may include various gaskets and seals disposed between the various components, and a plurality of springs for forcing the vanes outwardly from the rotor.

As described in greater detail below, the air motor is not used in the conventional manner to receive a supply of compressed air to act as a motor. Instead, the air motor is used to compress a flow of air through the air motor when the air motor is rotated in one of its two directions, and in doing so, acts to pneumatically govern the rewind speed of the spring retractable reel.

With reference again to FIGS. 3 and 4, the rotor rotates eccentrically in the chamber formed by the housing and the end plates. The rotor is off-center and its diameter is smaller than that of the chamber so that a crescent-shaped chamber is created. The rotor slots and vanes divide the chamber into separate working chambers of different sizes. As a result of the centrifugal force, which is often reinforced by the compressed flow of air, the vanes are forced against the cylinder wall to seal the individual chambers. The number of vanes in the air motor typically ranges between 3 and 10.

A suitable air motor is available from Gast Manufacturing Inc. of Benton Harbor, Mich., model number 4AM-NRV-143 which includes 8 vanes. While an air motor has been described above, other suitable pneumatic retraction governors may be employed in the spring retractable reel of the present invention. For example, other suitable pneumatic retraction governors may include, a rotary vane pump such as disclosed in U.S. Pat. No. 2,662,483 issued to Smith et al, a vacuum pump such as disclosed in U.S. Pat. No. 3,193,190 issued to Lindberg, a rotating machine as disclosed in U.S. Pat. No. 3,282,222 issued to Raufeisen et al., and air pump or compressor as disclosed in U.S. Pat. No. 4,050,855 issued to Sakamaki et al. The entire subject matter of these patents is incorporated herein by reference.

Figure 5:
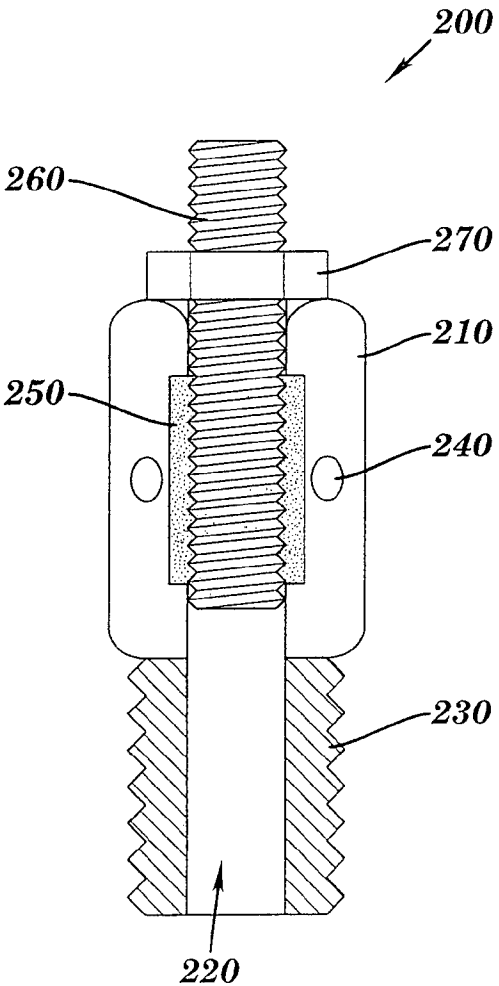
FIG. 5 is an enlarged, partially cut away view of the adjustable valve of FIG. 1.

With reference again to FIG. 1, an adjustable valve 200 is attached to air motor 100 for adjustably restricting a flow of air through the second port. The valve defines a second sized opening sized smaller than the first sized opening of the first port. FIG. 5 illustrates one embodiment of the adjustable valve 200. For example, the adjustable valve may include an elongated outer housing 210 having an axial passageway 220 extending therethrough. The lower end 230 may have external threads for engaging internal thread disposed in the second port of the air motor. A plurality of holes or apertures 240 may extend from the outside of housing 210 to axial passageway 220. A filter 250 such as a hollow cylindrical porous metal filter may be disposed in housing 210 to remove particles entering passageway 220 and the air motor. A pin or externally threaded member 260 is retained by internal threads in axial passageway 220. Pin 260 allows adjusting the amount of ambient air through the valve. A locking nut 270 may be provided to retain pin 260 in a fixed position. It will be appreciated that other valves may be suitably employed. For example, other valves may include needle valves.

With reference to FIGS. 1, 3, and 4, a muffler 300 may be attached to first port 150 (FIG. 2) of air motor 100 to quiet or reduce the noise of the air drawn in and forced out of the air motor. A suitable muffler such as Gast AC-990 may include a filtering system to filter out dust and debris as air is drawn in.

Second sprocket 37 (shown in FIG. 1) is mounted on an end 105 (shown in FIGS. 1 and 2) of shaft 122 of rotor 120. Chain 60 fixedly couples the rotation of the spool 30 and the first sprocket 35 to the rotation of the second sprocket 37 when the spool is moved in both the unwind and rewind directions. The first sprocket is sized larger than the second sprocket so that the rotor rotates at a greater rate compared to the spool. From the present description, it may be possible to fixedly couple the first sprocket to the second sprocket by having the sprockets engage each other and avoid the need for a chain.

The spring retractable reel may include a latch or ratchet assembly (not shown) that locks the reel at a specific point when line of material is withdrawn. A pull on the line of material disengages the latch for rewinding. To avoid injury when latch is disengaged, one typically holds onto the cable or hose and guides it onto the reel as it rewinds.

In operation, with reference to FIG. 3, when the line of material is pulled off the spool, the spring is tensioned and the rotor rotates generally freely in a first direction (arrow A) as a flow of air is draw through valve 200 into the chamber and generally unrestricted out the first port and muffler 300. Very little air is drawn into the air motor chamber through the adjusting valve, and since there is no restriction through the outlet, no compression of the air occurs and the reel freely rotates without the use of a clutch bearing. In addition, since the rotor in the air motor rotates generally slowly when an operator withdraws the line of material, there is little compression of the air in the air motor, and the vanes are not pressed tightly against the wall forming the chamber thereby not sealing the various working chambers. This results in little resistance to removing the line of material from the spool. Any resistance is primarily due to the tensioning of the spring.

With reference to FIG. 4, when the spool rewinds the line of material under the action of the spring, the chain rotates the rotor in an opposite direction (arrow B), which in turn draws air through the first port and muffler 300, which air is restricted from exiting the second port due to valve 200 thereby compressing air within the chamber to regulate the speed at which the spool rewinds the line of material. Closing valve 200 allows less air to escape, which increases the internal pressure in the air pump and results in a slower retraction of the line of material on the reel. Opening value 200 allows more air to escape, which decreases the internal pressure in the air pump and results in a faster retraction of the line of material on the reel.

In addition, during initial rewinding and at slow speeds, part of the compressed air flows under the vanes to press them against the cylinder wall to seal the various working chambers. Further, when the rotor rotates, the vanes are forced against the wall of the cylinder by centrifugal force.

The adjustable valve can be adjusted to reduce or increase the flow of ambient air through the air motor. The restricted flow causes a resistance to rotation of the rotor shaft causing a braking force on the spring reel through sprocket 37, chain 60, and sprocket 35. This braking force is generally proportional to the rotational speed of the reel. This causes the reel to reach a maximum desired speed, which can be set by the operator of the spring reel by adjusting the adjustable valve. Limiting the retraction rate of the reel makes the reel safer to operate, and reduces the likelihood of dangers associated with an unrestrained retraction of the line of material on the reel. The pneumatic retraction governors of the present invention may be installed on existing spring retraction reels or may be included as original equipment on new spring retraction reels.

The present invention for a spring retractable reel having a pneumatic retraction governor or air motor for regulating the rewind speed of the reel desirably operates well in all temperature ranges (sub-freezing to very hot). Once the desired speed is set with the adjustable valve, the selected speed will generally remain constant irrespective of the ambient temperature. In comparison to a hydraulic regulator or governor, the viscosity of the hydraulic fluid will vary with temperature leading to variations in speed as the ambient temperature changes.

In addition, the present invention has a faster recovery than a hydraulic regulator or governor. Since air has very low viscosity, it can react more quickly to outside events, e.g., the speed of the spool, and counteract those forces almost instantly, whereas the hydraulic based solutions typically take longer to respond. For example, the air motor employed in the present invention will react quickly to slow down and maintain the speed of the retracting reel as compared to a hydraulic governors which are typically slow in reacting to slow down the retracting reel.

Further, the present invention does not require a one-way clutch bearing which are typically required on spring-retractable reels employing a hydraulic governor, since there is no viscous resistance to overcome when pulling a cable or a hose off the reel employing an air motor as a pneumatic governor as described above.

Although various embodiments have been depicted and described in detail herein, it will be apparent to those skilled in the relevant art that modifications, additions, substitutions and the like can be made without departing from the spirit of the present invention and these are, therefore, considered to be within the scope of the present invention as defined in the following claims.

The invention claimed is:

1. A spring retractable reel which pneumatically governs the retraction of a line of material, the spring retractable reel comprising:

a frame;

a spool rotatably supported on said frame;

a spring for biasing said spool to take up the line of material;

an air motor mounted on said frame, said air motor comprising:

a housing having a chamber therein;

a rotor having an axial shaft and a plurality of vanes, said rotor being eccentrically disposed relative to said chamber of said housing;

a first port in communication with ambient air and opening into said chamber on a first side of said rotor; and a second port in communication with ambient air and opening into said chamber on a second side of said rotor;

an adjustable valve for adjustably restricting a flow of ambient air through said second port, said valve defining a second sized opening sized smaller than a first sized opening of said first port;

a first sprocket mounted on spool for rotation therewith;

a second sprocket mounted on said shaft of said rotor;

a chain for fixedly coupling the rotation of said spool and said first sprocket to the rotation of said second sprocket in both an unwinding direction and a retraction direction, and said first sprocket being larger than said second sprocket; and wherein when the line of material is pulled off said spool in said unwinding direction, said spring is tensioned and said rotor rotates generally freely as a flow of ambient air is draw through said valve into said chamber and generally unrestricted out said first port into ambient air, and when said spool rewinds the line of material under the action of the spring in said retraction direction, said rotor rotates in an opposite direction, which in turn draws a flow of ambient air through said first port, a portion of the flow of the ambient air drawn through said first port being restricted from exiting said second port due to said valve thereby compressing air within said chamber to regulate the speed at which said spool rewinds the line of material.

2. The spring retractable reel of claim 1 wherein said valve comprises an adjustable pin.

3. The spring retractable reel of claim 1 further comprising the line of material disposable on said spool and wherein the line of material comprises a hose.

4. The spring retractable reel of claim 1 further comprising the line of material line disposable on said spool and wherein the line of material comprises an electrical cable.

5. A method for regulating a speed of retraction of a line of material, the method comprising:

providing a spring retractable reel having the line of material, the spring retractable reel comprising:

a frame;

a spool rotatably supported on the frame;

a spring for biasing the spool to take up the line of material;

an air motor mounted on the frame, the air motor comprising:

a housing having a chamber therein;

a rotor having an axial shaft and a plurality of vanes, the rotor being eccentrically disposed relative to the chamber of the housing;

a first port in communication with ambient air and opening into the chamber on a first side of the rotor; and a second port in communication with ambient air and opening into the chamber on a second side of the rotor;

an adjustable valve for adjustably restricting a flow of ambient air through the second port, the valve defining a second sized opening sized smaller than a first sized opening of the first port;

a first sprocket mounted on spool for rotation therewith;

a second sprocket mounted on the shaft of the rotor;

a chain for fixedly coupling the rotation of the spool and the first sprocket to the rotation of the second sprocket in both an unwinding direction and a retraction direction, and the first sprocket being larger than the second sprocket; and wherein when the line of material is pulled off the spool in the unwinding direction, the spring is tensioned and the rotor rotates generally freely as a flow of ambient air is draw through the valve into the chamber and generally unrestricted out the first port into ambient air, and when the spool rewinds the line of material under the action of the spring in the retraction direction, the rotor rotates in an opposite direction, which in turn draws a flow of ambient air through the first port, a portion of the flow of the ambient air drawn through the first port being restricted from exiting the second port due to the valve thereby compressing air within the chamber to regulate the speed at which the spool rewinds the line of material;

dispensing the line of material from the spring retractable reel to tension the spring;

retracting the line of material on the spool under the action of the spring; and regulating the flow of air out of the valve so that air in the air motor is compressed and the speed at which the line of material is retracted is regulated.

6. The method of claim 5 further comprising adjusting the valve to adjust the flow of air through the air motor thereby adjusting the speed at which the line of material is retracted.

7. A spring retractable reel which pneumatically governs the retraction of a line of material, the spring retractable reel comprising:

a frame;

a spool rotatably supported on said frame;

a spring for biasing said spool to take up the line of material;

a pneumatic retraction governor mounted on said frame, said pneumatic retraction governor having a house having a chamber therein, a rotor having a plurality of vanes, a first port having a first opening, and a second port;

a valve for adjustably restricting a flow of air through said second port, said valve defining a second sized opening sized smaller than said first sized opening of said first port;

means for fixedly coupling a rotation of said spool to a rotation of said rotor of said pneumatic retraction governor in both an unwinding direction and a retraction direction; and wherein when the line of material is pulled off said spool, said spring is tensioned and said rotor rotates generally freely as a flow of ambient air is draw through said valve into said chamber and generally unrestricted out said first port into ambient air, and when said spool rewinds the line of material under the action of said spring in the retraction direction, said rotor rotates in an opposite direction, which in turn draws ambient air through said first port, a portion of the flow of ambient air drawn through said first port is restricted from exiting said second port due to said valve thereby compressing air within said chamber to regulate the speed at which said spool rewinds the line of material.

8. The spring retractable reel of claim 7 wherein said means for fixedly coupling the rotation of the rotor is operable to rotate said rotor at a greater rate than the rate of rotation of said spool.

9. The spring retractable reel of claim 7 wherein said valve comprises an adjustable pin.

10. The spring retractable reel of claim 7 further comprising the line of material disposable on said spool and wherein the line of material comprises a hose.

11. The spring retractable reel of claim 7 further comprising the line of material disposable on said spool and wherein the lines of material comprises an electrical cable.

12. A method for regulating a speed of retraction of a line of material, the method comprising:

providing a spring retractable reel having the line of material, the spring retractable reel comprising:

a frame;

a spool rotatably supported on the frame;

a spring for biasing the spool to take up the line of material;

a pneumatic retraction governor mounted on the frame, the pneumatic retraction governor having a housing having a chamber therein, a rotor having a plurality of vanes, a first port having a first opening, and a second port;

a valve for adjustably restricting a flow of air through the second port, the valve defining a second sized opening sized smaller than the first sized opening of the first port;

means for fixedly coupling a rotation of the spool to a rotation of the rotor of the pneumatic retraction governor in both an unwinding direction and a retraction direction; and wherein when the line of material is pulled off the spool, the spring is tensioned and the rotor rotates generally freely as a flow of ambient air is draw through the valve into the chamber and generally unrestricted out the first port into ambient air, and when the spool rewinds the line of material under the action of the spring in the retraction direction, the rotor rotates in an opposite direction, which in turn draws ambient air through the first port, a portion of the flow of ambient air drawn through the first port is restricted from exiting the second port due to the valve thereby compressing air within the chamber to regulate the speed at which the spool rewinds the line of material;

dispensing the line of material from the spring retractable reel to tension the spring;

retracting the line of material on spool under the action of the spring; and regulating a flow of air out of the valve so that air in the pneumatic retraction governor is compressed and the speed at which the line of material is retracted is regulated.

13. The method of claim 12 further comprising adjusting the valve to adjust the flow of air through the pneumatic retraction governor thereby adjusting the speed at which the line of material is retracted.

14. A method for retracting a line of material on a spool, the method comprising:

dispensing the line of material from the spool rotating in a first direction to tension a spring;

releasing the tension of the spring to rotate the spool in a second opposite direction to retract the line of material on the spool; and compressing a portion of a continuous flow of ambient air in a chamber in which the continuous flow of ambient air is received through a first port and discharged out a different second port into ambient air to regulate the speed of retraction of the line of material on the spool.

15. The method of claim 14 further comprising adjusting the flow of ambient air to adjust the speed at which the line of material is retracted.

16. The method of claim 14 wherein the compressing comprises providing a rotor having a plurality of vanes disposed in the chamber.

17. The method of claim 14 wherein the line of material comprises at least one of a hose and an electrical cable.

* * * * *

UNITED STATES PATENT AND TRADEMARK OFFICE

CERTIFICATE OF CORRECTION

PATENT NO. : 7,475,841 B2
APPLICATION NO. : 11/621138
DATED : January 13, 2009
INVENTOR(S) : Fancher It is certified that error appears in the above-identified patent and that said Letters Patent is hereby corrected as shown below:

Claim 7, Col. 8, Line 44: Delete “a house having” and insert -- a housing having --

Claim 11, Col. 9, Line 12: Delete “the lines of” and insert -- the line of --

Signed and Sealed this

Ninth Day of June, 2009

JOHN DOLL
*Acting Director of the United States Patent and Trademark Office*